US006666548B1

(12) United States Patent
Sadasivan et al.

(10) Patent No.: US 6,666,548 B1
(45) Date of Patent: Dec. 23, 2003

(54) METHOD AND APPARATUS FOR CONTINUOUS MARKING

(75) Inventors: Sridhar Sadasivan, Rochester, NY (US); David J. Nelson, Rochester, NY (US); Seshadri Jagannathan, Pittsford, NY (US); Thomas C. Jackson, Honeoye Falls, NY (US); Glen C. Irvin, Jr., Rochester, NY (US); Ramesh Jagannathan, Rochester, NY (US); Suresh Sunderrajan, Rochester, NY (US); Rajesh V. Mehta, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/287,579

(22) Filed: Nov. 4, 2002

(51) Int. Cl.[7] ..... B41J 2/02; B41J 2/09

(52) U.S. Cl. ..... 347/77

(58) Field of Search ..... 347/5, 6, 75, 77, 347/78, 80; 209/3.1; 250/251, 288

(56) References Cited

U.S. PATENT DOCUMENTS

| | | | | |
|---|---|---|---|---|
| 1,941,001 A | | 12/1933 | Hansell | |
| 3,373,437 A | | 3/1968 | Sweet et al. | |
| 3,416,153 A | | 12/1968 | Hertz et al. | |
| 3,878,519 A | | 4/1975 | Eaton | |
| 4,148,718 A | * | 4/1979 | Fulwyler | 209/3.1 |
| 4,346,387 A | | 8/1982 | Hertz | |
| 4,734,227 A | | 3/1988 | Smith | |
| 4,746,928 A | * | 5/1988 | Yamada et al. | 347/75 |
| 4,878,064 A | * | 10/1989 | Katerberg et al. | 347/78 |
| 5,270,542 A | * | 12/1993 | McMurry et al. | 250/288 |
| 5,408,255 A | * | 4/1995 | Emerson | 347/80 |
| 5,565,677 A | * | 10/1996 | Wexler et al. | 250/251 |
| 6,116,718 A | | 9/2000 | Peeters et al. | |
| 6,254,211 B1 | * | 7/2001 | Simon et al. | 347/6 |
| 6,435,637 B1 | * | 8/2002 | Lyman | 347/5 |

FOREIGN PATENT DOCUMENTS

| | | | | |
|---|---|---|---|---|
| JP | 2001208673 A | * | 8/2001 | G01N/15/02 |

* cited by examiner

*Primary Examiner*—Anh T. N. Vo
(74) *Attorney, Agent, or Firm*—William R. Zimmerli

(57) ABSTRACT

A method and an apparatus for continuously delivering a solvent free marking material to a receiver includes a printhead with a discharge device is provided. The discharge device has an outlet and is in fluid communication with a pressurized reservoir of a thermodynamically stable mixture of a compressed fluid solvent and a marking material. The marking material becomes free of the solvent after ejected through the discharge device. A deflection mechanism is positioned relative to the outlet of the discharge device. The deflection mechanism is adapted to selectively deflect the marking material away from a first path to a second path. A gutter is positioned at an end of the first path, and the solvent free marking material is collected by the gutter. A receiver transporting mechanism is positioned at an end of the second path and the receiver transporting mechanism is adapted to provide a receiver to allow solvent free marking material be deposited on the receiver.

28 Claims, 5 Drawing Sheets

METHOD AND APPARATUS FOR CONTINUOUS MARKING

FIELD OF THE INVENTION

This invention relates generally to the field of digitally controlled marking devices, and in particular to continuous type marking devices adapted to deposit solvent free marking materials.

BACKGROUND OF THE INVENTION

Many different types of digitally controlled printing are known and currently in production. These printing systems use a variety of actuation mechanisms, a variety of marking materials, and a variety of recording media. Examples of digital printing systems in current use include: laser electrophotographic printers; LED electrophotographic printers; dot matrix impact printers; thermal paper printers; film recorders; thermal wax printers; dye diffusion thermal transfer printers; and ink jet printers. However, at present, such electronic printing systems have not significantly replaced mechanical printing presses, even though this conventional method requires a very expensive setup and is seldom commercially viable unless a few thousand copies of a particular page are to be printed. Thus, there is a need for improved digitally controlled printing systems, which are capable of producing high quality color images at high-speed and low cost, using standard paper.

Ink jet printing has become recognized as a prominent contender in the digitally controlled, electronic printing arena because, e.g., of its non-impact, low-noise characteristics, its use of plain paper and its avoidance of toner transfers and fixing. Ink jet printing mechanisms can be categorized as either continuous ink jet or drop on demand ink jet.

Continuous ink jet printing dates back to at least 1929. See U.S. Pat. No. 1,941,001 to Hansell. U.S. Pat. No. 3,373,437, which issued to Sweet et al. in 1967, discloses an array of continuous ink jet nozzles wherein ink drops to be printed are selectively charged and deflected towards the recording medium. This technique is known as binary deflection continuous ink jet.

U.S. Pat. No. 3,416,153, which issued to Hertz et al. in 1966, discloses a method of achieving variable optical density of printed spots in continuous ink jet printing using the electrostatic dispersion of a charged drop stream to modulate the number of droplets which pass through a small aperture. U.S. Pat. No. 3,878,519, which issued to Eaton in 1974, discloses a method and apparatus for synchronizing droplet formation in a liquid stream using electrostatic deflection by a charging tunnel and deflection plates.

U.S. Pat. No. 4,346,387, which issued to Hertz in 1982 discloses a method and apparatus for controlling the electric charge on droplets formed by the breaking up of a pressurized liquid stream at a drop formation point located within the electric field having an electric potential gradient. Drop formation is effected at a point in the field corresponding to the desired predetermined charge to be placed on the droplets at the point of their formation. In addition to charging tunnels, deflection plates are used to actually deflect drops.

Conventional ink jet printers are disadvantaged in several ways. For example, in order to achieve very high quality images having resolutions approaching 900 dots per inch while maintaining acceptable printing speeds, a large number of discharge devices located on a printhead need to be frequently actuated thereby producing an ink droplet While high frequency actuation reduces printhead reliability, it also limits the viscosity range of the ink used in these printers. Typically, the viscosity of the ink is lowered by adding solvents such as water, etc. The increased liquid content results in slower ink dry times after the ink has been deposited on the receiver which decreases overall productivity. Additionally, increased solvent content can also cause an increase in ink bleeding during drying which reduces image sharpness negatively affecting image resolution and other image quality metrics.

Conventional ink jet printers are also disadvantaged in that the discharge devices of the printheads can become partially blocked and/or completely blocked with ink. In order to reduce this problem, solvents, such as glycol, glycerol, etc., are added to the ink formulation, which can adversely affect image quality. Alternatively, discharge devices are cleaned at regular intervals in order to reduce this problem. This increases the complexity of the printer and educes effective printing time.

Another disadvantage of conventional ink jet printers is their inability to obtain true gray scale printing. Conventional ink jet printers produce gray scale by varying drop density while maintaining a constant drop size. However, the ability to vary drop size is desired in order to obtain true gray scale printing.

Other technologies that deposit a dye onto a receiver using gaseous propellants are known. For example, Peeters et al., in U.S. Pat. No. 6,116,718, issued Sep. 12, 2000, discloses a print head for use in a marking apparatus in which a propellant gas is passed through a channel, the marking material is introduced controllably into the propellant stream to form a ballistic aerosol for propelling non-colloidal, solid or semi-solid particulate or a liquid, toward a receiver with sufficient kinetic energy to fuse the marking material to the receiver. There is a problem with this technology in that the marking material and propellant stream are two different entities and the propellant is used to impart kinetic energy to the marking material. When the marking material is added into the propellant stream in the channel, a non-colloidal ballistic aerosol is formed prior to exiting the print head. This non-colloidal ballistic aerosol, which is a combination of the marking material and the propellant, is not thermodynamically stable/metastable. As such, the marking material is prone to settling in the propellant stream which, in turn, can cause marking material agglomeration, leading to nozzle obstruction and poor control over marking material deposition.

Technologies that use supercritical fluid solvents to create thin films are also known. For example, R. D. Smith in U.S. Pat. No. 4,734,227, issued Mar. 29, 1988, discloses a method of depositing solid films or creating fine powders through the dissolution of a solid material into a supercritical fluid solution and then rapidly expanding the solution to create particles of the marking material in the form of fine powders or long thin fibers, which may be used to make films. There is a problem with this method in that the free-jet expansion of the supercritical fluid solution results in a non-collimated/defocused spray that cannot be used to create high resolution patterns on a receiver. Further, defocusing leads to losses of the marking material.

As such, there is a need for a technology that permits high speed, accurate, and precise delivery of marking materials to a receiver continuously to create high resolution images. There is also a need for a technology that permits continuous delivery of ultra-small (nano-scale) marking material particles of varying sizes to obtain gray scale. There is also a need for a technology that permits continuous delivery of solvent free marking materials to a receiver. There is also a need for a technology that permits high speed, accurate, and precise imaging on a receiver having reduced material agglomeration characteristics.

SUMMARY OF THE INVENTION

According to one feature of invention an apparatus for continuously delivering a solvent free marking material to a receiver includes a printhead with a discharge device. The discharge device has an outlet and is in fluid communication with a pressurized reservoir of a thermodynamically stable mixture of a compressed fluid solvent and a marking material. The marking material becomes free of the solvent after being ejected through the discharge device. A deflection mechanism is positioned relative to the outlet of the discharge device. The deflection mechanism is adapted to selectively deflect the marking material away from a first path to a second path.

A gutter can be positioned at an end of the first path which collects the solvent free marking material. A receiver transporting mechanism can be positioned at an end of the second path and is adapted to provide a receiver on which the solvent free marking material is deposited.

According to another feature of the invention a method of continuously delivering a solvent free marking material to a receiver includes providing a pressurized reservoir of a thermodynamically stable mixture of a compressed fluid solvent and a marking material. The mixture of the thermodynamically stable mixture of the compressed fluid solvent and the marking material is delivered along a first path toward a gutter or, alternatively, a receiver transport mechanism. The marking material becomes free of the solvent. The marking material is selectively deflected away from the first path to a second path to a receiver positioned on a receiver transport mechanism or, alternatively, a gutter.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art. Additionally, materials identified as suitable for various facets of the invention, for example, marking materials, solvents, equipment, etc. are to be treated as exemplary, and are not intended to limit the scope of the invention in any manner.

Figure 1:
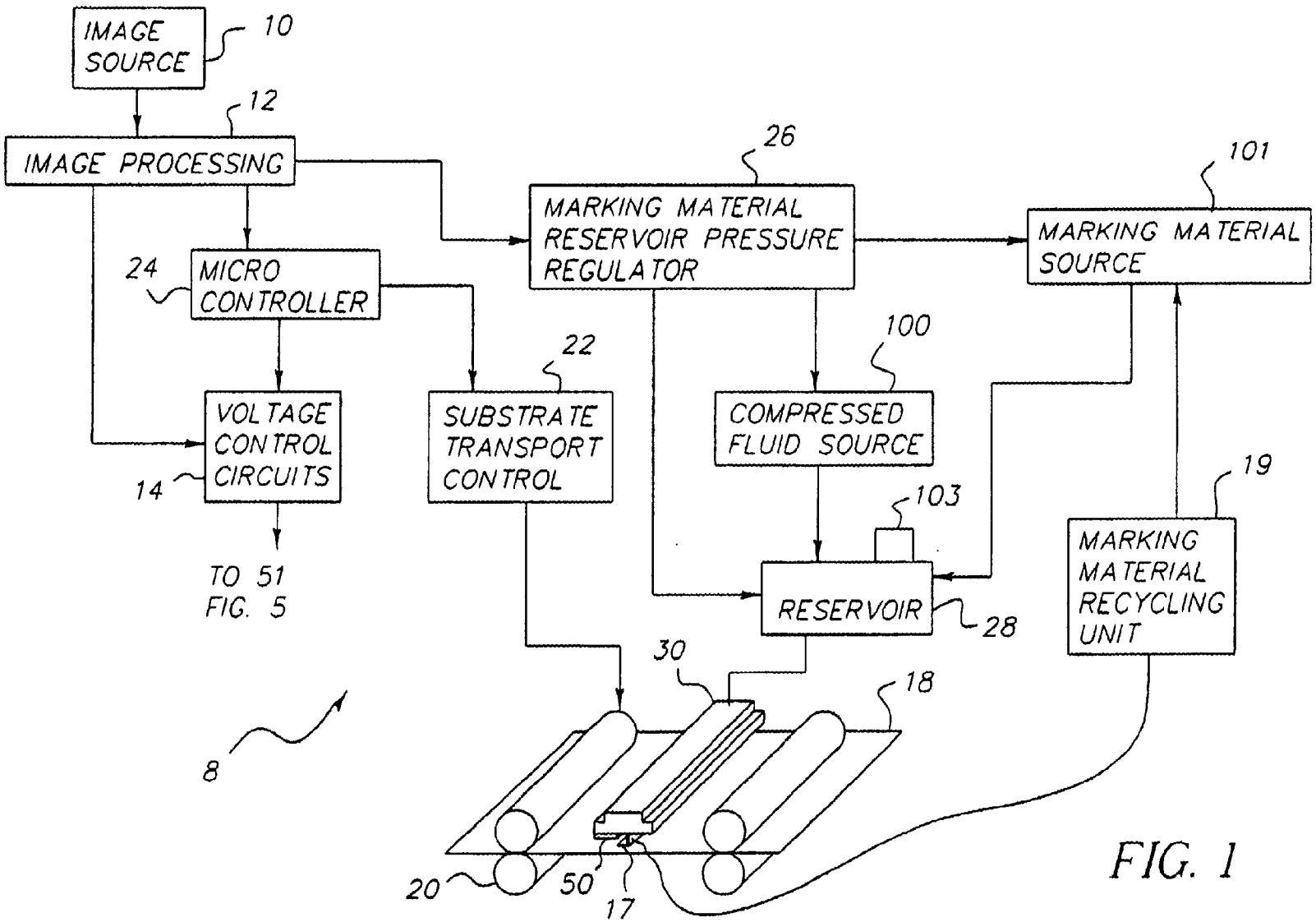
FIG. 1 is a schematic view of a first embodiment made in accordance with the present invention.

Referring to FIG. 1, a continuous marking system 8 includes an image source 10 such as a scanner or computer which provides raster image data, outline image data in the form of a page description language, or other forms of digital image data. This image data is converted to half-toned bitmap image data by an image processing unit 12 which also stores the image data in memory. A plurality of voltage control circuits 14 read data from the image memory and apply time-varying electrical pulses to a set of deflector plates 51 (shown in FIGS. 5 and 6). These pulses are applied at an appropriate time so that the solvent free marking materials delivered by printhead 30 in a continuous stream are deposited on a substrate 18 in the appropriate position designated by the data in the image memory.

Substrate 18 is moved relative to printhead 30 by a recording medium transport system 20, which is electronically-controlled by a substrate transport control system 22, and which in turn is controlled by a microcontroller 24. The substrate transport system shown in FIG. 1 is a schematic only, and many different mechanical configurations are possible. For example, a transfer roller could be used as substrate transport system 20 to facilitate transfer of solvent free marking material to substrate 18. Such transfer roller technology is well known in the art. In the case of page width printheads, it is most convenient to move substrate 18 past a stationary printhead. However, in the case of scanning print systems, it is usually most convenient to move the printhead along one axis (the sub- scanning direction) and the recording medium along an orthogonal axis (the main scanning direction) in a relative raster motion. Other possible configurations have been discussed in detail in pending application Ser. No. 10/016,054 and pending application Ser. No. 10/163,326.

The marking material is contained in a reservoir 28 under pressure. In the non-printing state, continuous stream of the marking materials are unable to reach substrate 18 due to an gutter 17 that blocks the stream and which may allow a portion of the marking material to be recycled by an marking material recycling unit 19. In one embodiment of the invention, the marking material recycling unit 19 is a collection device for the solvent free marking material.

The reservoir 28 has a pressurized source of a thermodynamically stable mixture of a fluid and a marking material, herein after referred to as a formulation reservoir connected in fluid communication to a delivery path formed in/on a printhead 30. The printhead 30 includes a discharge device 50 positioned along the delivery path configured (discussed below with reference to FIGS. 3A, 3B, and 4) to produce a shaped beam of the marking material.

The formulation reservoir 28 is connected in fluid communication to a source of fluid 100 and a source of marking material 101. Alternatively, the marking material can be added to the formulation reservoir 28 through a port 103.

One formulation reservoir 28 can be used when single color printing is desired. Alternatively, multiple formulation reservoirs 28*a*, 28*b*, and 28*c* (not shown) can be used when multiple color printing is desired. When multiple formulation reservoirs 28*a*, 28*b*, and 28*c* are used, each formulation reservoir 28*a*, 28*b*, and 28*c* is connected in fluid communication through delivery path to a dedicated discharge device 50. One example of this includes dedicating a first row of discharge devices 50 to formulation reservoir 28*a*; a second row of discharge devices 50 to formulation reservoir 28*b*; and a third row of discharge devices to formulation reservoir 28*c*. Other formulation reservoir discharge device combinations exist depending on the particular printing application.

A discussion of illustrative embodiments follows with like components being described using like reference symbols.

Again referring to FIG. 1, a first embodiment is shown. In this embodiment, the printhead 30 can be connected to the formulation reservoir(s) 28 using essentially rigid, inflexible tubing 101. As the marking material delivery system is typically under high pressure from the supercritical fluid source 100, through tubing 101 and the formulation reservoir 28 the tubing 101 can have an increased wall thickness which helps to maintain a constant pressure through out the marking material delivery system 8. Alternately, a suitable flexible hose can be, for example, a Titeflex extra high pressure hose P/N R157-3 (0.110 inside diameter, 4000 psi rated with a 2 in bend radius) commercially available from Kord Industrial, Wixom, Mich.

Figure 2:
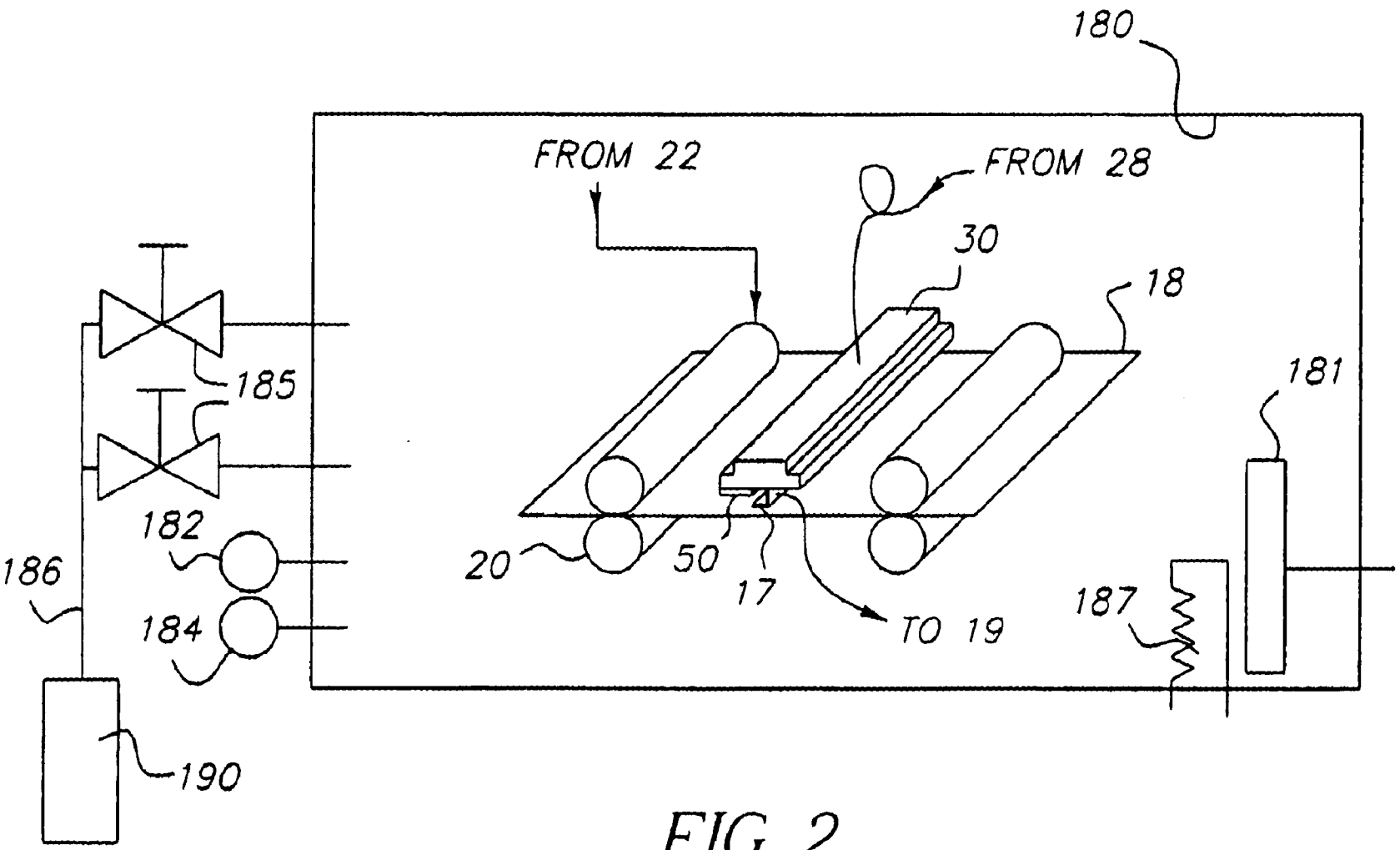
FIG. 2 shows a controlled environment for printing with the embodiment shown in FIG. 1.

Another embodiment of the invention is shown in FIG. 2. In this embodiment, the substrate 18, the gutter 17 and the printhead 30 are located within a controlled environment, for example, a chamber 180. The chamber 180 shown in FIG. 2 is designed for use at extreme pressures. For example, the chamber 180 can be held at a predetermined pressure ranging from about 100 atmospheres to about $1\times10^{-9}$ atmospheres. Incorporated in the chamber is a pressure modulator 181. The pressure modulator as shown resembles a piston. This is for illustration only. The pressure modulator could also be a pump, or a vent used in conjunction with an additional pressure source. An example of an additional pressure source is the compressed fluid source 190. This source is modulated with a flow control device 185 to enter the chamber via a delivery path 186. The pressure inside the chamber is carefully monitored by a pressure sensor 182. The pressure modulator could be a combination of skimmer and a vacuum pump. Skimmers used to reduce the pressure significantly to vacuum conditions are well known in art. Such skimmers are commercially available from Beam Dynamics Inc., San Carlos, Calif. The combination of skimmers and differential pumping can strip away the gas and produce ultra low vacuum conditions. In addition, the chamber is provided with temperature sensor 184 and temperature modulator 187. Temperature modulator 187 is shown as an electric heater but could consist of any of the following: heater, a water jacket, a pressure range, a refrigeration coil, a combination of temperature control devices. The deposition chamber serves to hold the substrate 18 and facilitates the deposition of the material.

Figure 3A:
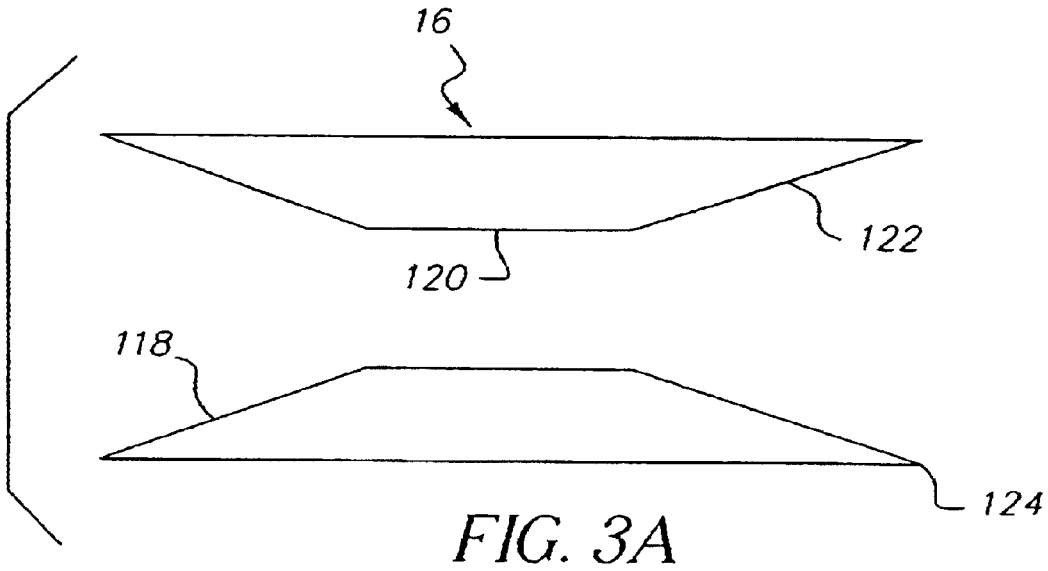
FIG. 3 shows a nozzle capable of collimating a beam of marking material.
Figure 3B:
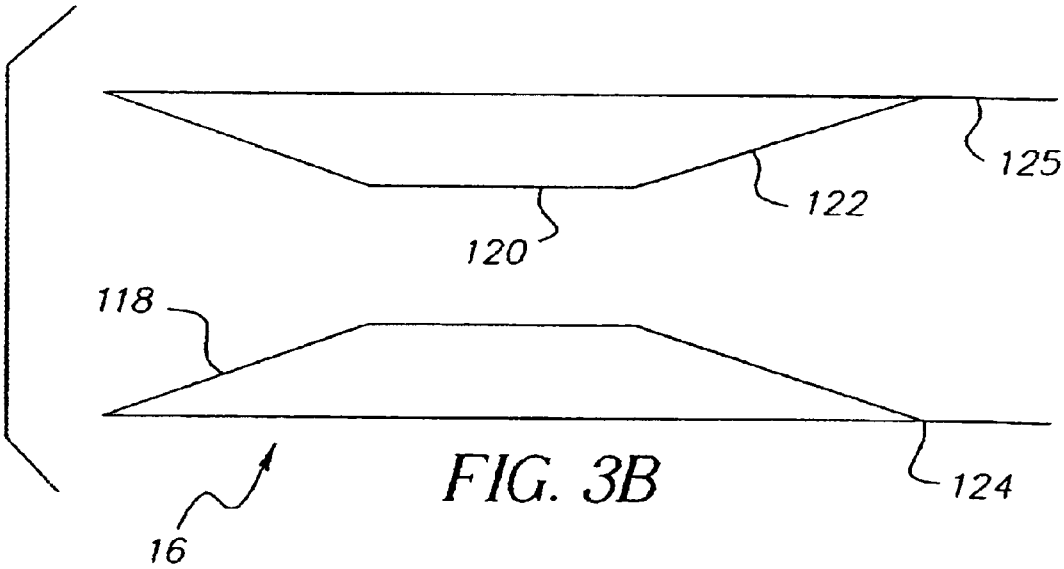

Referring to FIGS. 3A and 3B, the discharge device 50 of the print head 30 can be a nozzle 16. Nozzle 16 includes a first variable area section 118 followed by a first constant area section 120. A second variable area section 122 diverges from constant area section 120 to an end 124 of discharge device 50. The first variable area section 118 converges to the first constant area section 120. The first constant area section 118 has a diameter substantially equivalent to the exit diameter of the first variable area section 120. Alternatively, discharge device 50 can also include a second constant area section 125 (shown in FIG. 3B) positioned after the variable area section 122. Second constant area section 125 has a diameter substantially equivalent to the exit diameter of the variable area section 122. Discharge devices 50 of this type are commercially available from Moog, East Aurora, N.Y.; Vindum Engineering Inc., San Ramon, Calif., etc.

In one embodiment of discharge device 50, the diameter of the first constant area section 120 of the discharge device 50 ranges from about 20 microns to about 2,000 microns. In another embodiment, the diameter of the first constant area section 120 of the discharge device 50 ranges from about 10 microns to about 20 microns. Additionally, first constant area section 120 has a predetermined length from about 0.1 to about 10 times the diameter of first constant area section 120 depending on the printing application. An array of such discharge devices 50, to form a printhead 30 can be fabricated with modern manufacturing techniques such as focused ion beam machining, MEMS processes, etc.

Figure 4:
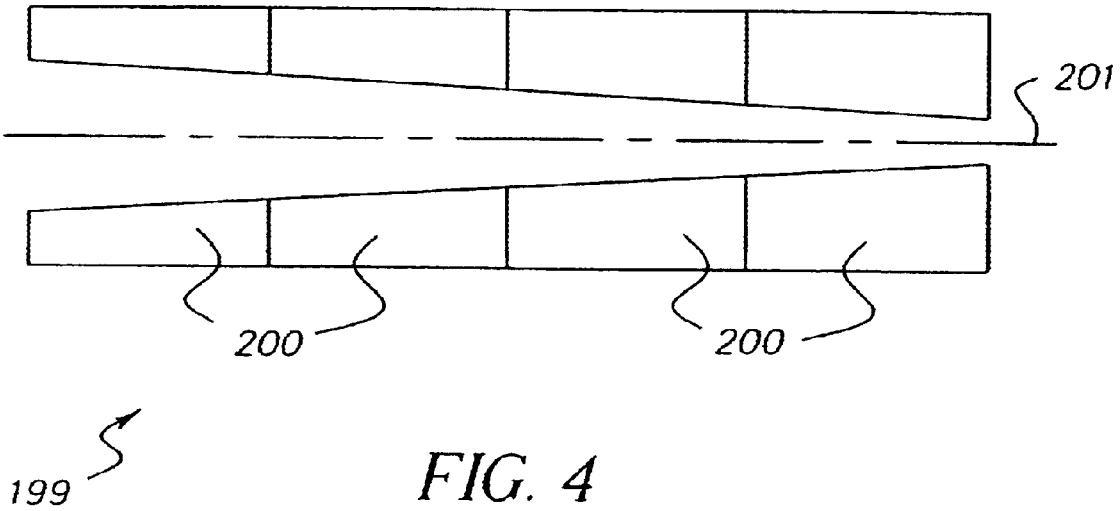
FIG. 4 shows an aerodynamic lens also capable of collimating the beam of marking material.

Referring to FIG. 4, the discharge device 50 can be an aerodynamic lens 199. Aerodynamic lens 199 includes a plurality of spaced lens arrangements 200 (also referred to as orifice plates, etc.). Such devices are also commercially available at MicroTherm LLC. The number of lens arrangements can vary from two to ten arranged in series with an axial opening. In one embodiment, the number of lens arrangements 200 can vary from three to six arranged in series with an axial opening 201. The axial opening diameter of the lens arrangement 200 varies from the largest at the beginning gradually reducing to smallest at the end (viewed from left to right in FIG. 4). The axial opening diameter of the lens arrangement can vary from 50 microns to 5 mm. The distance between each lens arrangement 200 can vary from 10 mm to 10 cm.

Alternatively, aerodynamic lens 199 can include a first capillary tube of a given diameter in fluid communication with a second capillary tube of smaller diameter. These capillary tubes can also include one or more lens arrangements 200 having one or more axial openings 201.

Referring to FIGS. 1–6, the marking material reservoir 28 takes a chosen solvent and/or predetermined marking materials to a compressed liquid and/or supercritical fluid state, makes a solution and/or dispersion of a predetermined marking material or combination of marking materials in the chosen compressed liquid and/or supercritical fluid, and delivers the marking materials as a collimated and/or focused beam onto a receiver 18 in a controlled manner. In a preferred printing application, the predetermined marking materials include cyan, yellow and magenta dyes or pigments.

In this context, the chosen materials taken to a compressed liquid and/or supercritical fluid state are gases at ambient pressure and temperature. Ambient conditions are preferably defined as temperature in the range from −100 to +100° C., and pressure in the range from $1\times10^{-8}$–1000 atm for this application.

A compressed fluid carrier, contained in the compressed fluid source 100, is any material that dissolves/solubilizes/disperses a marking material. The compressed fluid source 100 delivers a compressed fluid (for example, any material with a density greater than 0.1 grams/cc) carrier at predetermined conditions of pressure, temperature, and flow rate as a supercritical fluid, compressed gas, or a compressed liquid. Materials that are above their critical point, as defined by a critical temperature and a critical pressure, are known as supercritical fluids. The critical temperature and critical pressure typically define a thermodynamic state in which a fluid or a material becomes supercritical and exhibits gas like and liquid like properties. Materials that are at sufficiently high temperatures and pressures below their critical point are known as compressed liquids. Materials that are at sufficiently high pressures and temperatures below their critical point are known as compressed gasses. Materials in their supercritical fluid and/or compressed liquid/gas state that exist as gases at ambient conditions find application here because of their unique ability to solubilize and/or disperse marking materials of interest when in their compressed liquid, compressed gas, or supercritical state.

Fluid carriers include, but are not limited to, carbon dioxide, nitrous oxide, ammonia, xenon, ethane, ethylene, propane, propylene, butane, isobutane, chlorotrifluoromethane, monofluoromethane, sulphur hexafluoride and mixtures thereof. In a preferred embodiment, carbon dioxide is generally preferred in many applications, due its characteristics, such as low cost, wide availability, etc.

The formulation reservoir 28 is utilized to dissolve and/or disperse predetermined marking materials in compressed liquids, compressed gases or supercritical fluids with or without dispersants and/or surfactants, at desired formulation conditions of temperature, pressure, volume, and concentration. The combination of marking materials and compressed liquid/compressed gas/supercritical fluid is typically referred to as a mixture, formulation, etc.

The formulation reservoir 28 can be made out of any suitable materials that can safely operate at the formulation conditions. An operating range from 0.001 atmosphere ($1.013\times10^2$ Pa) to 1000 atmospheres ($1.013\times10^8$ Pa) in pressure and from −25 degrees Centigrade to 1000 degrees Centigrade is generally preferred. Typically, the preferred materials include various grades of high pressure stainless steel. However, it is possible to use other materials if the specific deposition or etching application dictates less extreme conditions of temperature and/or pressure.

The formulation reservoir 28 should be adequately controlled with respect to the operating conditions (pressure, temperature, and volume). The solubility/dispersibility of marking materials depends upon the conditions within the formulation reservoir 28. As such, small changes in the operating conditions within the formulation reservoir 28 can have undesired effects on marking material solubility/dispensability.

Additionally, any suitable surfactant and/or dispersant material that is capable of solubilizing/dispersing the marking materials in the compressed liquid/supercritical fluid for a specific application can be incorporated into the mixture of marking material and compressed liquid/supercritical fluid. Such materials include, but are not limited to, fluorinated polymers such as perfluoropolyether, siloxane compounds, etc.

The marking materials can be controllably introduced into the formulation reservoir 28. The compressed liquid/supercritical fluid is also controllably introduced into the formulation reservoir(s) 28. The contents of the formulation reservoir(s) 28 suitably mixed, using a mixing device to ensure intimate contact between the predetermined imaging marking materials and compressed liquid/compressed gas/supercritical fluid. As the mixing process proceeds, marking materials are dissolved or dispersed within the compressed liquid/compressed gas/supercritical fluid. The process of dissolution/dispersion, including the amount of marking materials and the rate at which the mixing proceeds, depends upon the marking materials itself, the particle size and particle size distribution of the marking material (if the marking material is a solid), the compressed liquid/supercritical fluid used, the temperature, and the pressure within the formulation reservoir(s) 28. When the mixing process is complete, the mixture or formulation of marking materials and compressed liquid/compressed gas/supercritical fluid is thermodynamically stable/metastable, in that the marking materials are dissolved or dispersed within the compressed liquid/compressed gas/supercritical fluid in such a fashion as to be indefinitely contained in the same state as long as the temperature and pressure within the formulation chamber are maintained constant. This state is distinguished from other physical mixtures in that there is no settling, precipitation, and/or agglomeration of marking material particles within the formulation chamber, unless the thermodynamic conditions of temperature and pressure within the reservoir are changed. As such, the marking material and compressed liquid/supercritical fluid mixtures or formulations of the present invention are said to be thermodynamically stable/metastable. This thermodynamically stable/metastable mixture or formulation is controllably released from the formulation reservoir(s) 28 through the discharge device 50 and deflection mechanism 51.

During the discharge process, the marking materials are precipitated from the compressed liquid/supercritical fluid as the temperature and/or pressure conditions change. The precipitated marking materials are preferably directed towards a substrate 18 by the discharge device 50 through the deflection mechanism 51 as a focussed and/or collimated beam. The invention can also be practiced with a non-collimated or divergent beam provided that the diameter of first constant area section 120 and printhead 30 to substrate 18 distance are appropriately small. For example, in a discharge device 50 having a 10 $\mu$m first constant area section 120 diameter, the beam can be allowed to diverge before impinging substrate 18 in order to produce a printed dot size of about 60 $\mu$m (a common printed dot size for many printing applications). Discharge device 50 diameters of these sizes can be created with modem manufacturing techniques such as focused ion beam machining, MEMS processes, etc.

The particle size of the marking materials deposited on the substrate 18 is typically in the range from 1 nanometer to 1000 nanometers. The particle size distribution may be controlled to be uniform by controlling the rate of change of temperature and/or pressure in the discharge device 50, the location of the substrate 18 relative to the discharge device 50, and the ambient conditions outside of the discharge device 50.

The print head 30 is also designed to appropriately change the temperature and pressure of the formulation to permit a controlled precipitation and/or aggregation of the marking materials. As the pressure is typically stepped down in stages, the formulation fluid flow is self-energized. Subsequent changes to the formulation conditions (a change in pressure, a change in temperature, etc.) result in the precipitation and/or aggregation of the marking material, coupled with an evaporation of the supercritical fluid and/compressed gas/or compressed liquid. The resulting precipitated and/or aggregated marking material deposits on the substrate 18 in a precise and accurate fashion. Evaporation of the supercritical fluid/compressed gas/compressed liquid can occur in a region located outside of the discharge device 50. Alternatively, evaporation of the supercritical fluid and/or compressed liquid can begin within the discharge device 50 and continue in the region located outside the discharge device 50. Alternatively, evaporation can occur within the discharge device 50.

A beam (stream, etc.) of the marking material and the supercritical fluid/compressed gas/compressed liquid is formed as the formulation moves through the discharge device 50. When the size of the precipitated and/or aggregated marking materials is substantially equal to an exit diameter of the discharge device 50, the precipitated and/or aggregated marking materials have been collimated by the discharge device 50. When the sizes of the precipitated and/or aggregated marking materials are less than the exit diameter of the discharge device 50, the precipitated and/or aggregated marking materials have been focused by the discharge device 50.

The substrate 18 is positioned along the path such that the precipitated and/or aggregated predetermined marking materials are deposited on the substrate 18. The distance of the substrate 18 from the discharge device 50 is chosen such that the supercritical fluid and/or compressed liquid evaporates from the liquid and/or supercritical phase to the gas phase prior to reaching the substrate 18. Hence, there is no need for a subsequent receiver drying processes. Alternatively, the substrate 18 can be electrically or electrostatically charged, such that the location of the marking material in the substrate 18 can be controlled.

It is also desirable to control the velocity with which individual particles of the marking material are ejected from the discharge device 50. As there is a sizable pressure drop from within the printhead 30 to the operating environment, the pressure differential converts the potential energy of the printhead 30 into kinetic energy that propels the marking material particles onto the substrate 18. The velocity of these particles can be controlled by suitable discharge device 50 and a deflection mechanism 51. Discharge device 50 design and location relative to the substrate 18 also determine the pattern of marking material deposition.

The temperature of the discharge device 50 can also be controlled. Discharge device temperature control may be controlled, as required, by specific applications to ensure that the opening in the discharge device 50 maintains the desired fluid flow characteristics.

The substrate 18 can be any solid material, including an organic, an inorganic, a metallo-organic, a metallic, an alloy, a ceramic, a synthetic and/or natural polymeric, a gel, a glass, or a composite material. The substrate 18 can be porous or non-porous. Additionally, the substrate 18 can have more than one layer. The substrate 18 can be a sheet of predetermined size. Alternately, the substrate 18 can be a continuous web.

Additional marking material can be dispensed through printhead in order to improve color gamut, provide protective overcoats, etc. When additional marking materials are included, check valves and printhead design help to reduce marking material contamination. Additionally, a premixed reservoir(s) 28, containing premixed predetermined marking materials and the supercritical fluid and/or compressed liquid are connected in fluid communication through tubing 110 to printhead 30. The premixed reservoir(s) 28 can be supplied and replaced either as a set, or independently in applications where the contents of one reservoir are likely to be consumed more quickly than the contents of other reservoirs. The size of the premixed reservoir(s) 28 can be varied depending on anticipated usage of the contents. The premixed reservoir(s) 28 are connected to the discharge devices 50 through delivery paths 110. When multiple color printing is desired, the discharge devices 50 and delivery paths 110 are dedicated to a particular premixed reservoir(s) 28.

Figure 5:
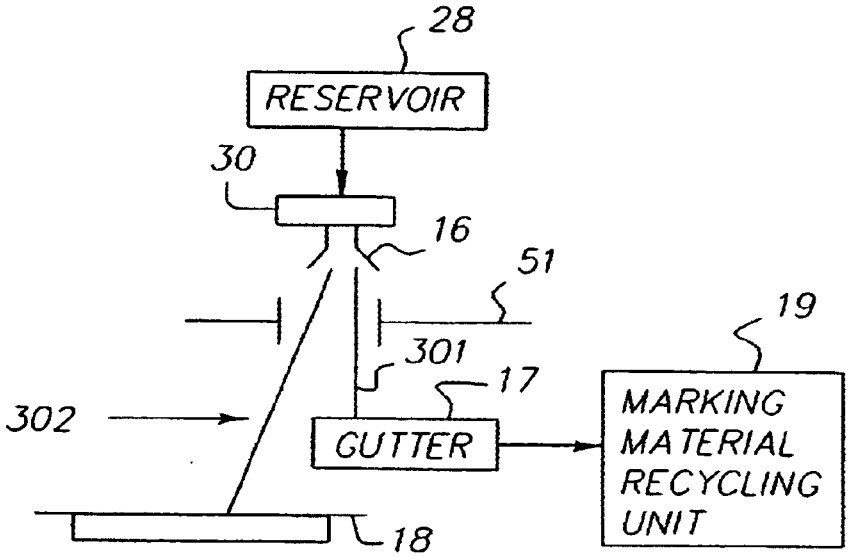
FIG. 5 is a schematic view of the embodiment shown in FIG. 1.
Figure 6:
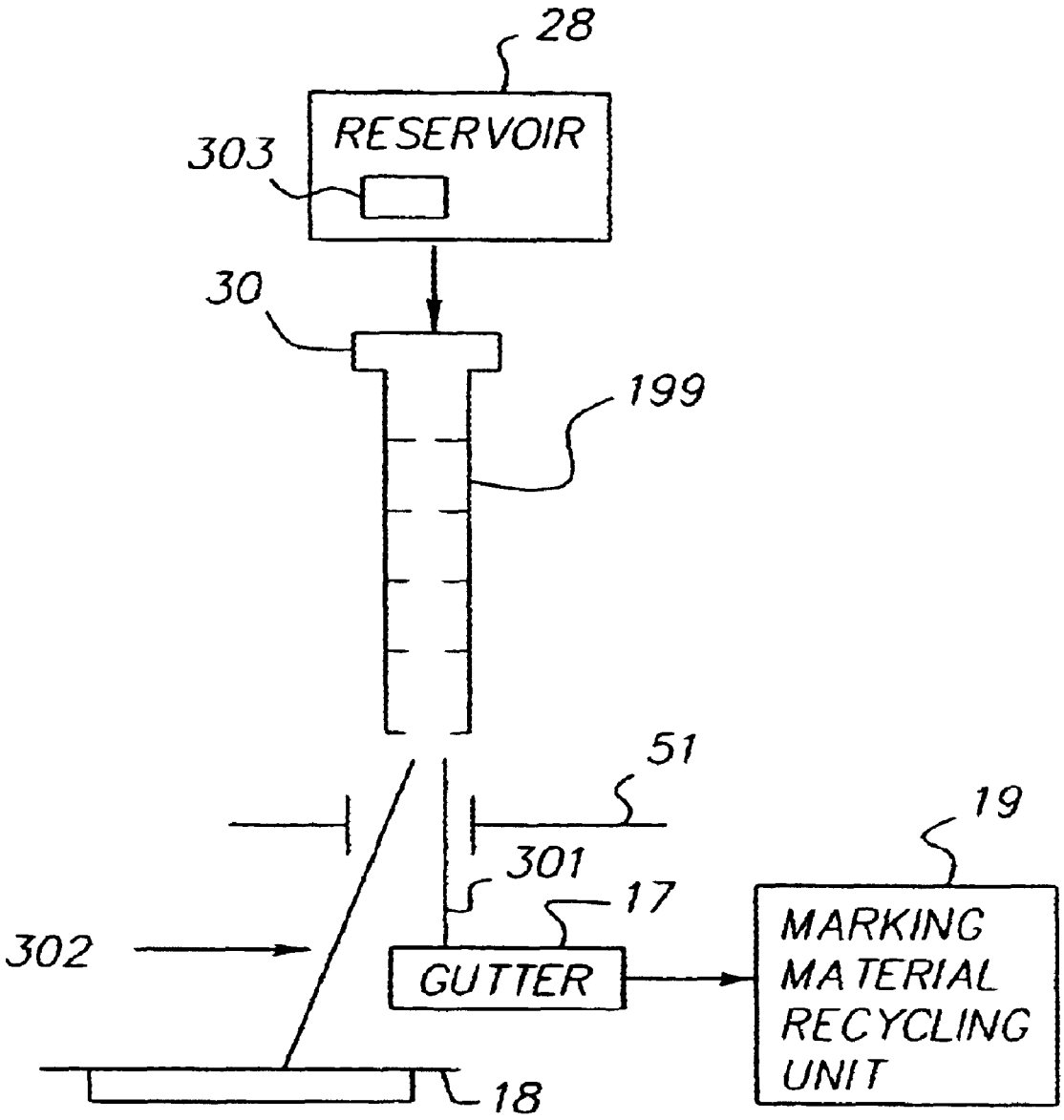
FIG. 6 is a schematic view of a second embodiment made in accordance with the present invention.

Referring to FIG. 5 and FIG. 6, schematic views of additional embodiments of the present invention are shown. The embodiments shown in FIG. 5 and FIG. 6 show one nozzle and one deflection mechanism. In practice, however, a plurality of nozzles and deflection mechanism will typically be used in the continuous marking device 8.

The precipitated marking materials are preferably directed towards the substrate 18 continuously by a suitably shaped discharge device 50. The discharge device 50 can be a nozzle 16 arrangement shown in FIG. 5 or an aerodynamic lens 199 arrangement shown in FIG. 6. Upon exiting the discharge device, the marking material stream can follow one of two paths shown in FIG. 5 and FIG. 6. The marking material stream can follow the first path 301 and be deposited in a gutter 17 connected to a marking material recycling unit 19. The marking material stream can be selectively deflected to a second path 302 and be deposited as a solvent free marking material onto substrate 18 by a deflection mechanism 51. Alternatively, the first path 301 can be the material delivery path ending at substrate 18 while second path 302 becomes the gutter path.

The deflection mechanism 51 used to deflect the solvent free marking material to the substrate 18 can be parallel plate device or einzel lens device. Alternatively, deflection mechanism 51 can be other types of electrostatic deflection devices, known in the art.

Prior to selective deflection, the marking material stream can be charged in several ways known in art. For example, formulation reservoir 28 can include a source 303 that electrically charges the material particles prior to the material being ejected from discharge device 50. The charge on the material particles allows selected material particles to be deflected by deflection mechanism 51 (for example, a parallel plate device). Alternatively, the marking materials can also be chosen such that the marking material stream becomes charged as it is ejected from discharge device 50 and does not need additional charging.

Each of the embodiments described above can be incorporated in a printing network for larger scale printing operations by adding additional printing apparatuses on to a networked supply of supercritical fluid and marking material. The network of printers can be controlled using any suitable controller. Additionally, accumulator tanks can be positioned at various locations within the network in order to maintain pressure levels throughout the network.

The invention has been described in detail with particular reference to certain preferred embodiments thereof, but it will be understood that variations and modifications can be effected within the scope of the invention.

What is claimed is:

1. An apparatus for continuously delivering a solvent free marking material to a receiver comprising:

a printhead having a discharge device, the discharge device having an outlet and being in fluid communication with a pressurized reservoir of a thermodynamically stable mixture of a compressed fluid solvent and a marking material, the marking material becoming free of the solvent after being ejected through the discharge device; and a deflection mechanism positioned relative to the outlet of the discharge device, wherein the deflection mechanism is adapted to selectively deflect the marking material away from a first path to a second path.

2. The apparatus according to claim 1, further comprising a gutter positioned at an end of the first path, wherein the solvent free marking material is collected by the gutter.

3. The apparatus according to claim 1, further comprising a receiver transporting mechanism positioned at an end of the second path, wherein the receiver transporting mechanism is adapted to provide a receiver to have solvent free marking material deposited thereon.

4. The apparatus according to claim 3, wherein the receiver transporting mechanism and the outlet of the discharge device are located in a controlled environment.

5. The apparatus according to claim 4, wherein the controlled environment comprises a pressure modulator for maintaining pressure in the controlled environment at a predetermined pressure level.

6. The apparatus according to claim 5, wherein the predetermined pressure level varies from about 100 atmospheres to about $1\times10^{-9}$ atmospheres.

7. The apparatus according to claim 1, further comprising a source of compressed fluid solvent in fluid communication with the reservoir of compressed fluid solvent and the marking material.

8. The apparatus according to claim 1, further comprising a source of marking material in fluid communication with the reservoir of compressed fluid solvent and the marking material.

9. The apparatus according to claim 1, wherein the reservoir of compressed fluid solvent and the marking material includes a reservoir pressure regulator adapted to adjust the internal pressure of the reservoir.

10. The apparatus according to claim 1, wherein the discharge device includes a first variable area section connected to one end of a first constant area section, and a second variable area section connected to another end of the first constant area section.

11. The apparatus according to claim 10, wherein the first variable area section is a converging area section.

12. The apparatus according to claim 10, wherein the second variable area section is a diverging area section.

13. The apparatus according to claim 10, wherein the discharge device includes a second constant area section connected to the second variable area section.

14. The apparatus according to claim 1, wherein the discharge device is an aerodynamic lens.

15. The apparatus according to claim 14, wherein the aerodynamic lens has a single lens element.

16. The apparatus according to claim 14, wherein the aerodynamic lens has a plurality of lens elements.

17. The apparatus according to claim 14, wherein the aerodynamic lens has at least three lens elements.

18. The apparatus according to claim 4, wherein the controlled environment comprises a temperature modulator for maintaining temperature in the controlled environment at a predetermined temperature level.

19. The apparatus according to claim 4, wherein the controlled environment comprises means for monitoring and adjusting temperature and pressure levels inside the controlled environment.

20. The apparatus according to claim 1, wherein the discharge device, and the deflection mechanism are located in a controlled environment.

21. The apparatus according to claim 20, wherein the controlled environment is in a vacuum condition.

22. The apparatus according to claim 1, wherein the deflection mechanism includes deflection plates.

23. The apparatus according to claim 1, further comprising a charging tunnel.

24. A method of continuously delivering a solvent free marking material to a receiver comprising:

providing a pressurized reservoir of a thermodynamically stable mixture of a compressed fluid solvent and a marking material;

delivering the mixture of the thermodynamically stable mixture of the compressed fluid solvent and the marking material along a first path, the marking material becoming free of the solvent; and selectively deflecting the marking material away from the first path to a second path.

25. The method according to claim 24, wherein the mixture is delivered in a controlled environment.

26. The method according to claim 24, further comprising collecting the marking material delivered along the first path in a gutter.

27. The method according to claim 26, further comprising recycling the marking material collected in the gutter.

28. The method according to claim 23, further comprising allowing the marking material travelling along the second path to the contact a receiver.

* * * * *